US005192418A

United States Patent [19]

Hughes et al.

[11] Patent Number: 5,192,418

[45] Date of Patent: Mar. 9, 1993

[54] METAL RECOVERY METHOD AND SYSTEM FOR ELECTROPLATING WASTES

[75] Inventors: Charles R. Hughes; Stewart T. Herman, both of Hellertown; Richard N. Steinbicker, Allentown, all of Pa.

[73] Assignee: Bethlehem Steel Corporation, Bethlehem, Pa.

[21] Appl. No.: 726,931

[22] Filed: Jul. 8, 1991

[51] Int. Cl.[5] ..... C02F 1/00

[52] U.S. Cl. ..... 205/100; 205/99; 204/182.3; 204/182.4; 204/DIG. 13; 210/634; 210/652; 210/665; 210/688; 210/912; 210/919

[58] Field of Search ..... 204/DIG. 13, 182.3, 204/182.4; 205/99, 100; 210/919, 912, 688, 665, 652, 634

[56] References Cited

U.S. PATENT DOCUMENTS

| | | | |
|---|---|---|---|
| 3,630,892 | 12/1971 | Hirs et al. | 428/402 |
| 3,681,210 | 8/1972 | Zievers et al. | 205/100 |
| 3,761,381 | 9/1973 | Yagishita | 204/238 |
| 3,957,452 | 5/1976 | Schaer et al. | 204/238 |
| 4,009,101 | 2/1977 | Hayashi | 210/688 |
| 4,376,706 | 3/1983 | Scott et al. | 210/688 |
| 4,416,737 | 11/1983 | Austin et al. | 204/DIG. 13 |
| 4,512,900 | 4/1985 | Macur et al. | 210/748 |
| 4,673,507 | 6/1987 | Brown | 210/681 |
| 4,783,249 | 11/1988 | Fishman | 204/DIG. 13 |
| 4,789,484 | 12/1988 | Ying et al. | 204/DIG. 13 |
| 4,840,712 | 6/1989 | Steinbicker et al. | 205/244 |
| 4,880,511 | 11/1989 | Sugita | 204/DIG. 13 |
| 4,943,360 | 7/1990 | Sugisawa et al. | 204/182.3 |
| 4,956,097 | 9/1990 | Courduvelis | 204/DIG. 13 |

*Primary Examiner*—John Niebling
*Assistant Examiner*—Kishor Mayekar
*Attorney, Agent, or Firm*—Shlesinger Arkwright & Garvey

[57] ABSTRACT

The present invention relates to a method of completely recovering nickel and zinc metal from multiple plating process waste streams by first separating the waste streams into a clean, relatively constant flow and/or concentration fraction and a dirty, variable flow and/or concentration fraction. Metal is recovered from the clean fraction by ion-exchange so as to concentrate the extracted metals for direct return to the plating bath. The effluent from the ion-exchange step is then blended with the dirty, variable flow and concentration fraction. This blended flow is first neutralized and then precipitated in a two-stage process using a sodium hydroxide solution. The resultant slurry containing the metal precipitate is filtered to yield a filter cake containing recovered nickel and zinc. This filter cake can then be further processed to recover the metal for reintroduction into the plating bath or for other uses.

18 Claims, 4 Drawing Sheets

DESTRUCTION OF PEROXIDE BY ACTIVATED CARBON
% Destruction vs Dwell Time

METAL RECOVERY METHOD AND SYSTEM FOR ELECTROPLATING WASTES

FIELD OF THE INVENTION

This invention relates to a process and system for recovering useful waste metals, such as nickel and zinc, from an iron substrate plating system. More particularly, the invention is directed to the recovery of waste metal from numerous process streams, some of which are extremely variable in flow and/or concentration and others of which are quite uniform in flow and concentration. The former waste streams include effluent from ion exchange units, end-of-run washdown flows, as well as sump, drain, and other dirty process flows.

BACKGROUND OF THE INVENTION

The tendency of iron or steel surfaces to corrode is well known in the industry. Very often, a metallic coating of nickel or zinc, or mixtures thereof, is applied to the surfaces to protect them from further corrosion. Zinc and nickel have been electroplated onto iron and steel substrates from various plating baths, preferably from acid plating baths, for protection of the surface for various uses in industry.

One such electroplating apparatus is described in U.S. Pat. No. 4,840,712 to Steinbicker et al., which is incorporated herein by reference, and discloses a pair of conductor rolls which direct a steel strip between a pair of plating anodes in a plating bath. The electroplating process utilizes a zinc sulfate electroplating solution as well as sulfuric acid rinsing water, so that the stainless steel conductor rolls are subjected to electrochemical corrosion and mechanical wear. The Steinbicker patent discloses a method for improving wear life of the conductor rolls by employing hydrogen peroxide as a passivating film formation agent within the rinse solution.

In recent years, the electroplating industry has experienced a steep rise in the cost of some of the metals used in coating iron and steel substrates. This is particularly true in the case of nickel, the price of which has fluctuated dramatically over the past few years. Nickel prices jumped from $2.37/lb. in January 1987 to over $7.00/lb. in April 1988. These large cost changes suggest some means for recovering the metal is required in order to minimize expense.

In addition, government regulations on discharge of effluents into the environment have increased dramatically. The electroplating industry has been especially hard hit by EPA disposal regulations, due to the solutions and wastes which arise during the electroplating process. Electroplating sludge is currently classified under EPA regulations as a "hazardous" waste, thereby increasing the cost and difficulty of its disposal. As a result, a steady increase in reprocessing and recovery of nickel, zinc and other plating metals from rinse solutions and plating baths has been experienced.

One method of recovering nickel and zinc from plating baths and rinse solutions includes treatment with an ion exchange resin to selectively adsorb the nickel or zinc cations onto the resin. A subsequent acid washing step will remove the recovered metals from the resin. Other available methods include electrodialysis and reverse osmosis technology. The use of ion exchange resin and other technology to remove useful metals from electroplating baths and rinse water is disclosed in U.S. Pat. No. 4,783,249 to Fishman, U.S. Pat. No. 4,009,101 to Hayashi, U.S. Pat. No. 3,761,381 to Yagishita, U.S. Pat. No. 3,681,210 to Zievers et al. and in U.S. Pat. No. 3,630,892 to Hirs et al.

Direct recovery of waste metals is most efficient from streams that are consistent in both flow and composition. For example, the conductor roll rinse and the rinse after plating streams are generally clean and constant in terms of flow and metal concentration. Ninety-five percent of the nickel and zinc contained in these wastewaters can be recovered by the ion exchange bed process.

"Other" waste streams are produced during the plating process, but these streams are too dirty and variable in flow and concentration to lend themselves to conventional ion bed separation. These dirty waste streams include effluent from the ion exchange units, end of run washdown flows and overflows from sumps, drains and spills.

Applicants have developed a method for direct recovery of the bulk of metals from the streams that are most consistent in flow and composition as well as reclamation of those metals that escape this primary metal recovery. Direct recovery of zinc and nickel is made from separately collected, relatively clean flows via two reciprocating flow, short-bed ion exchange units. The effluent from this process is then blended with other flows, such as drains, washdowns and spills, so that process upsets are minimized. These blended, variable streams are neutralized and precipitated in a two-stage process. The resultant slurry is filtered to yield a filter cake containing nickel and/or zinc which can then be further processed for reuse.

Although the use of an ion exchange resin has greatly increased the efficiency of recovering zinc and nickel from the plating waste streams, hydrogen peroxide added to the rinse solution to minimize conductor roll corrosion has an adverse effect on commercial cation exchange resin beads. Even minute quantities of hydrogen peroxide in the waste streams will oxidize the internal bonds that maintain the resin shape, thereby causing swelling and eventual depolymerization of the resin. Resin swelling causes a gradual increase in pressure drop across the ion exchange bed, and the eventual need for replacement. Hydrogen peroxide has a similar effect on electrodialysis and reverse osmosis membranes.

The present invention also discloses a method of removing the hydrogen peroxide from the conductor roll rinse solution during processing of the rinse water and plating bath solutions so that metal recovery of zinc and nickel may continue unimpeded. In the process, the conductor roll rinse, which contains hydrogen peroxide, is treated by contact with activated carbon to catalytically destroy the hydrogen peroxide before it can attack the ion exchange resin. The decomposition of the hydrogen peroxide occurs rapidly and effectively upon contact with the high surface area activated carbon bed.

SUMMARY OF THE INVENTION

The present invention relates to a method of recovering useful metals from a plurality of process streams, a first one of the streams being of a constant flow and/or concentration of a useful metal and a second one of the streams being of varying flow and/or concentration of the useful metal. The useful metal in the first stream is concentrated to a level sufficient to permit its return to the plating system from which it originated. The remaining dilute raffinate from the first stream is blended with the second stream. Free acid in the blended stream is neutralized by the addition of a strong base. A strong base also precipitates the useful metals out of solution. The metal precipitate is filtered or the water is otherwise removed to yield a cake material containing the useful metals recovered for reuse in the plating bath.

The present invention also relates to a system for recovering useful metals from a plurality of process streams, a first one of the streams being of a constant flow and/or concentration of a useful metal and a second one of the streams being of a varying flow and/or concentration of the useful metal. The system includes means for concentrating the useful metal in the first stream to a level sufficient to permit its return to the plating system from which it originated. An equalization tank is provided for combining any remaining dilute raffinate with the second stream to yield a blended stream. The system further includes means for neutralizing free acid in the blended stream and means for precipitation of the useful metals in the neutralized stream. A filter press or similar means for extracting water from the precipitate is provided to produce a cake material containing the recovered useful metal.

The present invention additionally discloses a method of recovering nickel and zinc metals from a plurality of process streams, a first one of the streams being of a constant flow and/or concentration of nickel and zinc and a second one of the streams being of a varying flow and/or concentration of nickel and zinc. The nickel and zinc in the first stream is concentrated to a level sufficient to permit its return to the plating system from which it originated. The remaining dilute raffinate from the first stream is blended with the second stream. Free acid in the blended stream is neutralized by the addition of a strong base. The nickel and zinc are precipitated from the neutralized stream by adding a quantity of base related to the ratio of zinc to nickel in solution. The zinc and nickel precipitate is then filtered or the water is otherwise removed to yield a cake material containing the recovered zinc and nickel suitable for processing and reuse.

The present invention also relates to a method for recovering useful metals from an iron substrate plating system which includes rinsing in a solution employing a passivating film formation agent. The plating solution which includes iron removed from the substrate is collected. Hydrogen peroxide is added to the collected plating solution to oxidize the iron to a ferric state, followed by raising the pH of the solution so as to cause the ferric iron to precipitate out of solution. After filtering off the iron precipitate, the rinse solution containing the passivating film formation agent is collected and the passivating film formation agent is catalytically destroyed. The rinse solution can then be safely passed through an ion exchange column so as to separate the metal cations from the anions for reuse within the plating bath.

The present invention further includes a system for recovering useful metals from an iron substrate plating system wherein the substrate is rinsed in a solution containing a passivating film formation agent. The system includes iron substrate plating means, means for applying a passivating film formation agent rinse solution to at least one conductor roll, means for removing the passivating film formation agent from the conductor roll rinse solution, as well as an ion exchange treatment means for separating the metal cations from the treated rinse solution for eventual reintroduction back into the plating bath.

In another embodiment of the present invention, there is provided a method for recovering nickel and zinc from an iron substrate plating system which includes rinsing in a solution that contains hydrogen peroxide as a passivating film formation agent. The method includes the steps of collecting the plating solution containing nickel and zinc as well as iron removed from the substrate followed by the addition of hydrogen peroxide to oxidize the iron to the ferric state. The pH of the solution is raised by an amount sufficient to cause the ferric iron to precipitate, followed by filtering of the ferric iron precipitate. The rinse solution containing the hydrogen peroxide passivating film formation agent is collected and treated with an activated carbon filter to catalytically destroy the hydrogen peroxide. The treated rinse solution is then be passed through an ion exchange column where the nickel and zinc metal cations are separated from the anions and reintroduced into the plating bath.

DETAILED DESCRIPTION OF THE INVENTION

Figure 1:
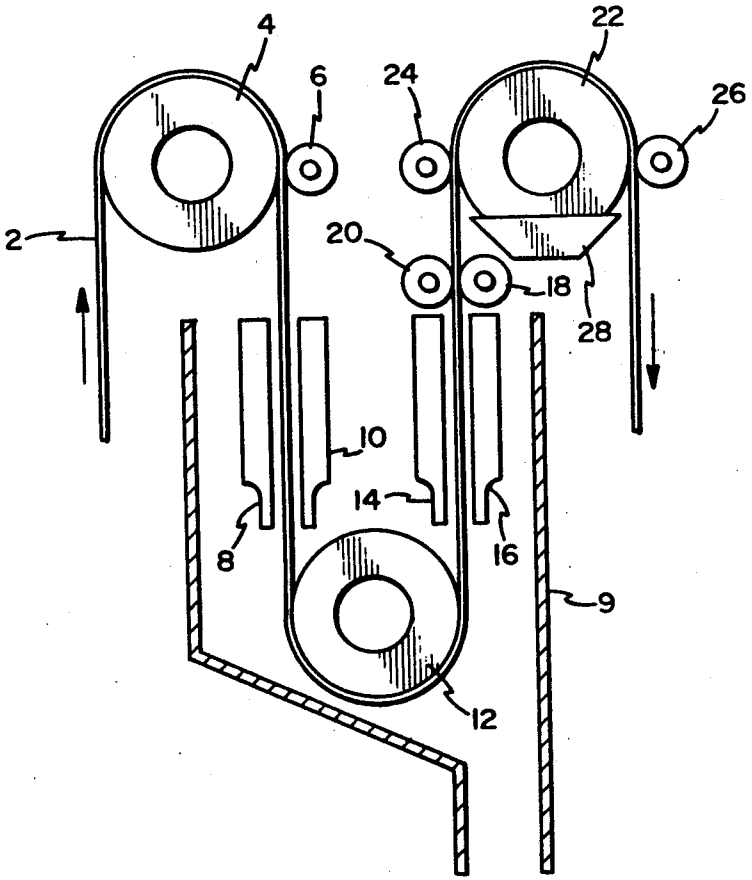
FIGURE 1 (PRIOR ART)
FIG. 1 is a schematic diagram of a prior art plating operation which incorporates conductor rolls and a rinse bath.

FIG. 1 discloses a prior art plating operation of the type employing conductor rolls and as described in U.S. Pat. No. 4,840,712 to Steinbicker et al., which is herein incorporated by reference. Steel strip 2 passes between a first conductor roll 4 and hold down roll 6 and then between anodes 8 and 10 in tank 9 filled with plating solution (not shown). The strip 2 then proceeds around rubber covered sink roll 12 to the next pair of plating anodes 14 and 16. The strip 2 passes from between the anodes 14 and 16 through squeegee rolls 18 and 20 and over a second conductor roll 22 extending between hold down rolls 24 and 26. An electric current associated with depositing nickel or zinc, or mixtures thereof, from the plating bath flows from the iron strip 2 to the conductor roll 22 and generates heat which is removed by cooling water (not shown) inside the conductor roll 22. The nickel or zinc ions in the plating solution tend to deposit on the surface of conductor roll 22, eventually achieving an amount sufficient to cause dents on the surface of the passing substrate strip 2.

To dissolve these zinc or nickel deposits, the conductor roll 22 is partially immersed in a dilute sulfuric acid solution contained in rinse pan 28. Thus, the conductor roll 22 is cyclically subjected to two corrosive environments—the plating solution and the rinse solution. To improve the wear-life of the steel conductor roll 22, the conductor roll rinse solution in pan 28 includes between about 50 ppm to about 1,000 ppm of hydrogen peroxide or a peroxydisulfate compound selected from the group consisting of sodium peroxydisulfate, potassium peroxydisulfate and ammonium peroxydisulfate. The use of hydrogen peroxide or other oxidizing agents reduces the corrosion rate of the conductor roll by accelerating the process of passive film formation during each active-passive transition cycle throughout the electroplating cycle.

The conductor roll rinse solution is contaminated not only with hydrogen peroxide, but also with metals from the plating bath which transfer from the steel strip 2 onto the conductor roll 22. Such metals include zinc and nickel, as well as iron which is eroded from the substrate during plating. In addition, the iron-containing coated steel substrate is often acid rinsed after galvanizing to remove excess electrolyte. This rinse after galvanizing solution is then returned to the working tanks. The end result of the plating process is a plethora of solutions containing metals and mineral acids of varying concentrations.

Figure 2:
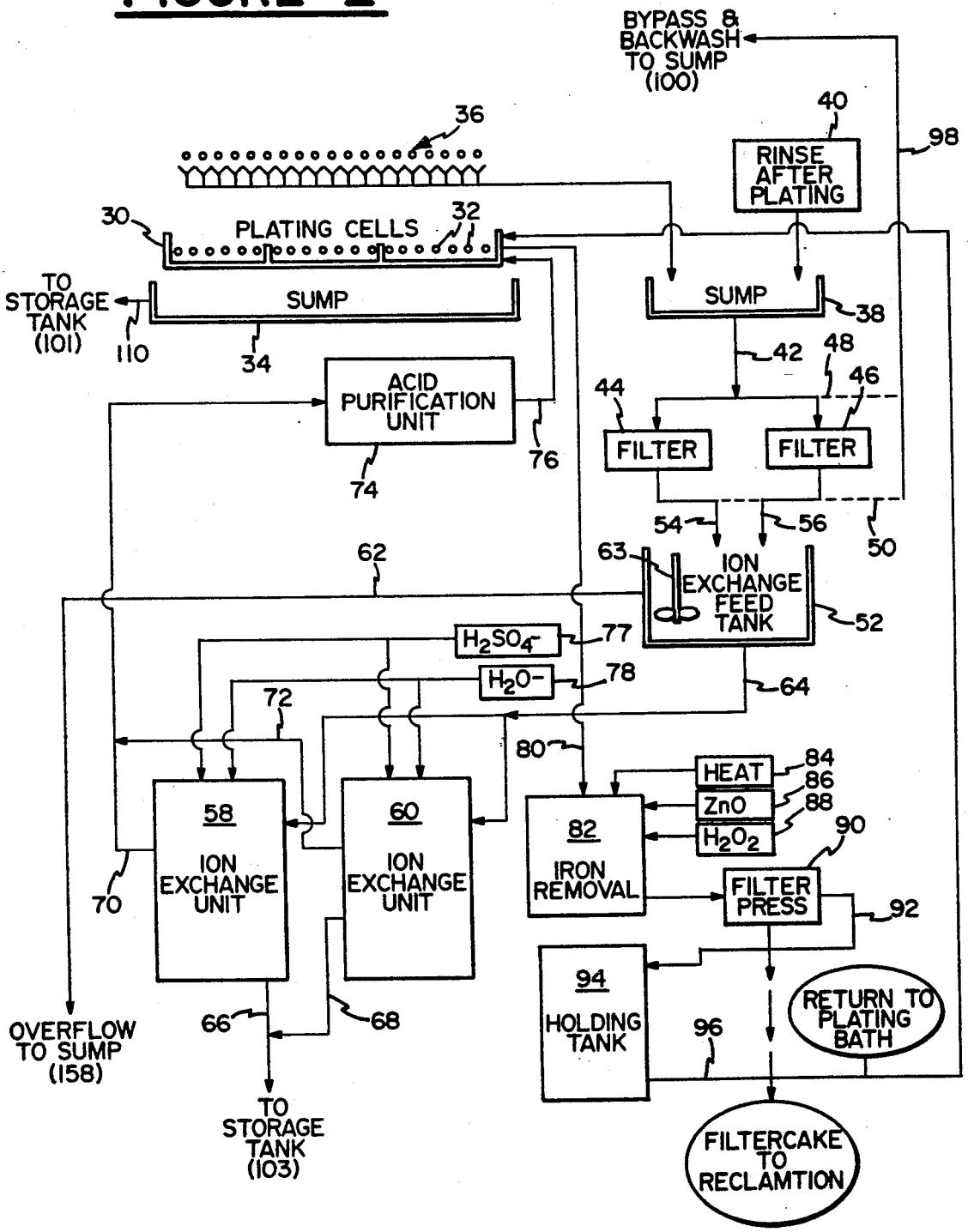
FIG. 2 is a fragmentary schematic diagram illustrating the method and system of the present invention for removing iron from the plating bath and the catalytic destruction of the hydrogen peroxide in the rinse solution prior to introduction into the ion exchange unit.

The metal reclamation and recovery process, including hydrogen peroxide destruction and mineral acid recovery, is best shown in FIG. 2 which illustrates a typical plating bath 30 containing the nickel and zinc plating electrolyte as well as a number of plating cells 32. A conventional sump 34 is positioned below the plating bath 30 to receive excess flows and spills from the plating bath 30. Conductor roll rinse apparatus 36 is shown containing a number of pans for applying rinse solution containing hydrogen peroxide and as disclosed in detail in U.S. Pat. No. 4,840,712 described above. The conductor roll rinse solution primarily contains dilute sulfuric acid recirculated from one of two 800 gallon tanks (not shown). The pH of the rinse solution is normally adjusted to fall within the range of 1.5 to 2.0.

Throughout the plating operation, the hydrogen peroxide containing rinse solution becomes mixed with the dragged-in electrolyte as it dissolves the zinc, nickel, and iron deposits from the conductor rolls during roll rinse. A portion of the conductor roll rinse is continually blown down to sump 38 to restrict rinse concentration to about 7 g/l zinc or nickel contaminant. Occasionally, the conductor roll rinse tank is emptied completely into the sump 38 and replaced with a fresh solution as needed. The sump 38 also receives the rinse after galvanizing solution 40. This slightly acidified rinse solution is applied counter-currently to the plated substrate to remove excess metal electrolyte. The solution is generally returned to the plating bath 30. In addition, the solution is continually supplemented with acid to effect a complete rinse of zinc and nickel from the moving steel sheet. This resultant discharge is directed into sump 38 or added to the plating bath 30 to compensate for water losses.

Analysis of the combined waste flows reveals a content of approximately 4.0 g/l zinc, 6.0 g/l nickel, 0.3 g/l iron and 3.7 g/l sulfuric acid. In addition, the conductor roll rinse, which comprises most of the volume entering sump 38, contains between 0 and 1,000 ppm hydrogen peroxide and has a temperature of between 85° F. and 125° F. The conductor roll rinse stream and the rinse after galvanizing stream enter the sump 38 at a rate of about 50 gpm. The preferred pH range of the combined rinse streams extend between about 1.5 and 2.0. A pH value below 1.2 tends to attack the conductor roll surface, while values beyond 2.5 cause iron within the rinse solution to prematurely precipitate into the process equipment. Consequently, the pH of the combined rinse solution must be adjusted to fall within the preferred range.

The combined flows from sump 38 enter, via line 42, into one of two activated carbon filters 44 and 46 which catalytically destroy the hydrogen peroxide within the rinse streams. Two filters are generally provided, and these normally operate in parallel except when one is backwashing as further described below. Additional filters may be added as needed. Activated carbon filter beds are generally operated in a downflow mode with backwashing in the upflow mode. Although other beds are contemplated within the scope of the present invention, the preferred embodiment incorporates an activated carbon bed which operates primarily in the upflow mode during normal use. The upflow design of the activated carbon bed allows oxygen gas which evolves during catalytic destruction of the hydrogen peroxide to vent. This oxygen gas is estimated to be at about 0.6 CFM. Typically the upflow beds operate at rates of between 1 and 2 gpm/sq. ft. Applicants have selected filters having a 54 inch diameter with a 30 inch deep carbon bed. The nominal flow rate treatment rate of about 2 gpm/sq. ft., and a detention time of about 4 minutes.

The oxygen gas which is generated can be vented from the top of the bed by a simple level control device or other appropriate equipment known in the art for venting collected gas when a particular level is reached.

The beds 44 and 46, as noted above, are backwashed in the upflow mode at which time the bed is expanded between 125% to in size. During normal operation, the activated carbon beds 44 and 46 can remove peroxide continuously for up to 48 hours without backwashing. Backwashing with water is run during a five minute period every 48 hours and at a flow rate of about 12 gal/min/sq. ft. Backwash from the filter beds 44 and 48 is directed via line 98 to sump 100 for storage in tank 101 and eventual treatment. Backwashing is periodically required to reorganize the bed and to flush out particulates captured by the carbon particles. Backwash lines 48 and 50 are depicted in phantom lines in order to indicate that activated carbon filtration may occur continuously as either of the activated carbon filter beds 44 or 46 is being backwashed. Appropriate valve means are also included (not shown). In order to minimize the need for backwashing, the combined rinse streams entering the filters from line 42 are subjected to pre-filtering in a sand filter or similar device prior to treatment in the activated carbon bed. Similarly, a discharge filter is provided at the outlet end of the filter beds to prevent carbon bed fines from reaching the downstream ion exchange resin bed. In general, flow rates beyond 2.5 gpm/sq. ft. tend to lift the bed undesirably, while flow rates below 2.0 gpm/sq. ft. are less economical and have no apparent catalytic advantage. Carbon bed consumption by the hydrogen peroxide is minimal, with average consumption losses of less than 1% of the bed per day.

The activated carbon which is used within the filter bed according to the present invention is a commercial grade, acid-washed activated carbon readily available in the marketplace. Acid-washed carbons are preferred in order to minimize the possibility of organic contamination of the electrolyte being returned to the plating bath. The preferred activated carbon is a bituminous, coal-based product manufactured by Calgon Corporation and sold under the trademark CPG-LF ®. The size of the activated carbon chosen is related to peroxide destruction. The 12×40 mesh size yields the highest peroxide destruction results for the system disclosed. Near total peroxide destruction has been documented using Calgon CPG-LF ® 12×40 mesh activated carbon with rinse solution flow rates of up to 2.6 gpm/sq. ft. and an inlet peroxide concentration up to 1,500 ppm.

Figure 5:
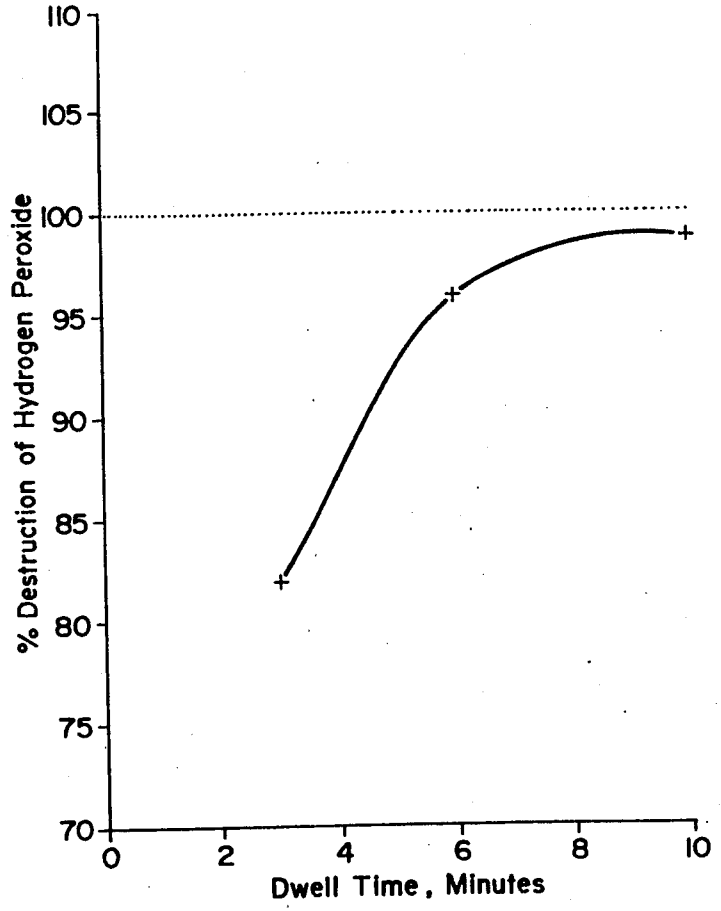
FIG. 5 illustrates the percent destruction of hydrogen peroxide in the conductor roll rinse stream by the activated carbon in static testing.

FIG. 5 summarizes the effectiveness of hydrogen peroxide destruction using activated carbon. The graph depicts percent destruction versus time for a static test. In this laboratory test, diluted plating solution (20:1) was dosed to about 500 ppm peroxide, heated to about 60° C. and mixed with 1/10 its weight of activated carbon for a test period. Initially there was rapid evolution of gas which was presumed to be oxygen. At the end of the test period, the carbon was filtered off and the solution was tested for residual peroxide. The results of the tests which are illustrated in FIG. 5 indicate that about 99% of the peroxide is destroyed within a ten minute detention period.

The requirement of total hydrogen peroxide destruction becomes apparent when examining the effect of hydrogen peroxide upon cation exchange resins. Applicants have documented the effect of hydrogen peroxide upon the Eco-Tec ® 3970 cation resin (manufactured by Eco-Tec Ltd., Pickering, Canada) by placing a 15 gram resin sample in a series of beakers, each having a zinc and nickel effluent solution with a peroxide concentration of from 1,000 ppm to 5 ppm. The resin was first equilibrated in a hydrogen peroxide-free synthetic solution, and hydrogen peroxide was added to meet the target concentration. Two methods of evaluation were then used to study the effect of peroxide on the resin. The first was a resin swelling test which involved baking the resin to determine its moisture content. The second test was a total-organic-carbon (TOC) analysis procedure, which assayed the amount of resin dissolved or disintegrated by the peroxide.

The data in Table 1 indicates that at peroxide levels of 500 ppm or greater, the resin will dissolve in the solution within 24 hours. At lower peroxide concentrations, the measurements of percent moisture determined by the resin swelling test did not significantly change from sample-to-sample i.e., the results were not proportional to peroxide concentrations. However, the total-organic-carbon analysis appeared quite sensitive to low peroxide levels, and may in fact be an even more accurate approach to predicting resin life than the resin swell test. The TOC evaluation involved measuring the TOC in the supernatant solution recovered after 7 days of testing. The data in Table 1 further indicates that the resin is severely affected at peroxide concentrations as low as 5 ppm. Peroxide concentrations were measured by two separate methods during the test. Concentrations of peroxide greater than 50 ppm were determined using permanganate titration, with lower concentration estimates made using the EM Quant Paper ® (manufactured by Merck Chemical Company) which is sensitive to fractional ppm concentrations of hydrogen peroxide.

TABLE 1

| | | Results on Resin Life from Laboratory Tests Conducted with ZnNi Conductor-Roll Rinse | | | |
|---|---|---|---|---|---|
| Test Number | Peroxide concentration (ppm) | Temperature (°C.) | Resin Destruction Time (days) | Swelling Test, Moisture (%) | Final Solution TOC Analysis (ppm) |
| 1 | 1000 | 60 | 1 | dissolved | |
| 2 | 500 | 50 | 1 | 83.2 | |
| 3 | 500 | 60 | 1 | dissolved | |
| 4 | 250 | 60 | 1 | 81.8 | |
| 5 | 100 | 60 | 2 | 86.1 | |
| 6 | 50 | 50 | 2 | 63.2 | |
| 7 | 50 | 60 | 2 | 62.6 | |
| 8 | 25 | 60 | 2 | 51.7 | |
| 9 | 0 | 60 | | 40.1 | |
| 10 | 25 | 60 | 4 | 76.0 | |
| 11 | 15 | 60 | 4 | 65.9 | |
| 12 | 15 | 50 | 4 | 66.6 | |
| 13 | 10 | 60 | 7 | 69.2 | 183 |
| 14 | 7.5 | 60 | 7 | 62.7 | 125 |
| 15 | 7.5 | 50 | 7 | 57.2 | 131 |
| 16 | 5 | 60 | 11 | 63.8 | 104 |
| 17 | 0 | 60 | | 52.9 | 2.2 |

The catalytically treated rinse solution exits the filters 44 and 46 and enters an ion exchange feed tank 52 via outlet lines 54 and 56. The ion exchange feed tank 52 collects the treated rinse solution for processing in two reciprocating flow, short-bed ion exchange units 58 and 60. The feed tank 52 can provide rinse solution on a continual basis to units 58, 60. Alternatively, feed tank 52 can operate to deliver metered "batches" of rinse solution to the ion exchange units 58 and 60 for treatment. The feed tank 52 incorporates a level switch (not shown) operably connected to outlet line 64 which extends between the tank 52 and the ion exchange units 58 and 60. When a predetermined amount of rinse solution has been accumulated within feed tank 52, the level switch opens the outlet line 64, allowing the rinse solution therein to enter the selected ion exchange unit 58 or 60. An overflow line 62 is also provided to direct excess rinse solution from tank 52 into overflow sump 158 for storage. Outlet line 64 is provided with appropriate valve means (not shown) which functions to allow each of the units 58 and 60 to operate simultaneously or, in the alternative, to close off flow from one of the units while allowing flow to continue into the remaining unit.

During normal operation, flow is directed via line 64 into one of the units 58 or 60 until the resin in the unit becomes saturated and "breakthrough" of non-adsorbed useful metals occur. The valve means incorporated in line 64 will then divert flow to the other unit for continued ion exchange of the rinse solution in the event a sufficient amount of solution is present in tank 52 while the first unit is backwashed and regenerated. If sufficient solution is not present in tank 52, then the valve prevents flow therefrom while the solution is being collected. In this way, useful metals from the relatively uniform flow and/or concentration stream can be extracted on a continuous basis. Other methods for directly extracting metal from the rinse solution such as electrodialysis, reverse osmosis and solvent extraction may also be used in place of the ion exchange units 58 and 60.

As noted above, the ion exchange units 58 and 60 are of the reciprocating flow, short-bed type described in U.S. Pat. 4,673,507 to Brown and which is herein incorporated by reference. The unit is commercially known as the Recoflo ® Ion Exchange Unit (manufactured by Eco-Tec Limited, Pickering, Canada). Ion exchange resins normally employed within the ion exchange units are of the styrene-based, strong-acid cation resin type. Typical of such resins is the ECO-TEC 3970 ® Cation Resin (manufactured by Eco-Tec Limited, Pickering, Canada). These ion exchange resins have a size less than 40 mesh, preferably in the 80–120 mesh range. The effective size is typically 0.12 mm, which is approximately 25% that of normal commercial resins. The rinse solution is subjected to ion exchange recovery within the units 58 and 60 so as to recover 95% of the zinc and nickel metal from the rinse solution and in a form that can be directly returned to the plating bath for reuse.

During the ion exchange process, nickel and zinc bearing rinse water is pumped through the cation bed within the selected one of the ion exchange units 58 and 60. The acid treated cation resin exchanges metal ions for hydrogen ions according to equation (1) where "R" represents cation exchange resin and "RH" represents freshly regenerated resin in the hydrogen form:

$$Ni^{++}+2RH \rightarrow 2H^{+}+R_2Ni \quad (1)$$

$$Zn^{++}+2RH \rightarrow 2H^{+}+R_2Zn$$

Figure 3:
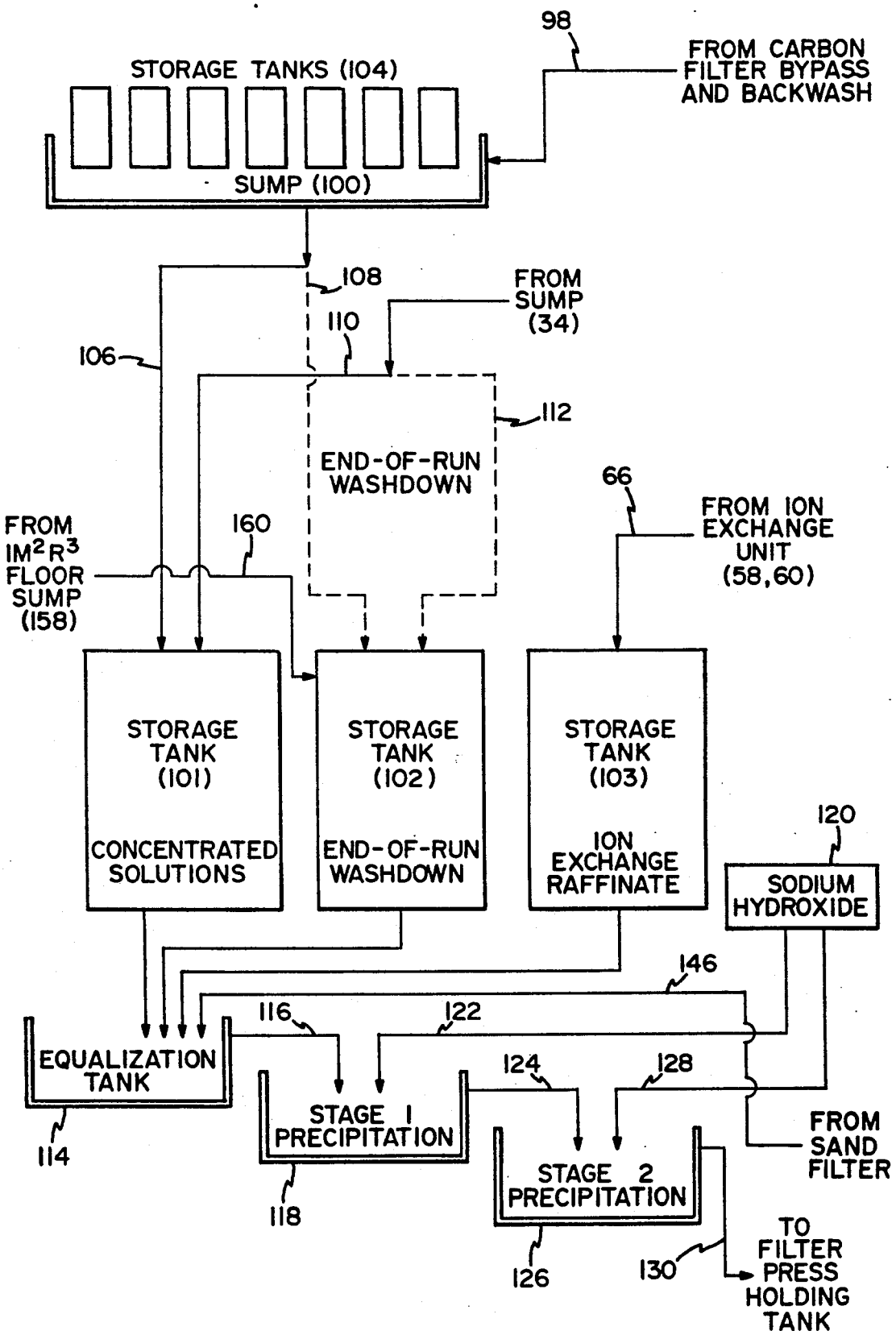
FIG. 3 is a fragmentary schematic diagram of the present invention illustrating the blending of separate overflow and dilute streams followed by neutralization and precipitation of the useful metals in a two-stage process.

The effluent anions flow from the ion exchange units 58 and 60 via lines 66 and 68 for collection as "other" waste within storage tank 103 (FIG. 3). This exchange continues until the metal ions begin to "break-through", i.e. the resin can no longer adsorb the metal ions. When this exhaustion of the resin has begun, the rinse solution flow to that particular unit is stopped while flow is allowed to proceed or continue to the remaining, non-saturated ion exchange units. "Break-through" of the resin can be determined by measuring conductivity or by the use of a colorimeter on effluent flow exiting the ion exchange units 58, 60. The resin is then regenerated with sulfuric acid in a second step to produce a relatively concentrated nickel sulfate and/or zinc sulfate solution according to equation (2):

$$R_2Ni+2H^{+} \rightarrow Ni^{++}+2RH \quad (2)$$

$$R_2Zn+2H^{-} \rightarrow Zn^{++}+2RH$$

In a third step, the nickel sulfate/zinc sulfate solution containing residual free acid is removed from the ion exchange units 58 and 60 as a product via lines 70 and 72. This nickel/zinc solution, which contains residual free acid, enters acid purification unit 74 where free acid in solution is sorbed by the resin contained in the acid purification unit 74. The acid purification unit 74 contains a deacidification resin for sorbing mineral acids. Such deacidification resins have the ability to sorb strong acids, while excluding salts of those acids. The acid can then be desorbed from the resin with water. This process is well known in the art, and is conventionally referred to as acid retardation. The deacidification resins are also well known in the art, and any such cation-based resins are contemplated within the scope of the present invention. Typical of such resins are the Eco-Tec 2350 ® Deacidification Resin (manufactured by Eco-Tec Limited, Pickering, Canada).

The nickel/zinc sulfate solution passes through the acid purification unit 74 and is directed via line 76 directly into the plating bath 30 as product. The recovered acid from the acid purification unit 74 can then be directed back to sulfuric acid reservoir 77 associated with each of the ion exchange units 58 and 60. In addition, a water source 78 is provided in fluid communication with each of the ion exchange units 58 and 60 for washing the bed to remove the zinc sulfate/nickel sulfate product, as well as washing the reclaimed acid back into the sulfuric acid tank 77. When the sulfuric acid tank 77 has been refilled with reclaimed acid, a small quantity of concentrated sulfuric acid is added to bring the acid strength back to the concentration required for the next cycle. Strongly acidic effluent or raffinate containing small quantities of nickel and zinc which have not been sorbed onto the cation bed exit the ion exchange units 58 and 60 via outlet lines 66 and 68. This variable waste stream is directed to storage tank 103 while awaiting further processing to extract any remaining metals.

Throughout the plating process, iron from the substrate strip 2 contaminates the electrolyte plating bath thereby having an insidious effect on product quality. This iron contaminate is introduced into the plating bath in any of several ways, including drag-out from the pickle rinse of the substrate strip 2 when plating one-sided products and use of uncoated or poorly coated lead substrate strips. As such, the concentration of iron contaminants within the plating bath must be kept below a maximum concentration of 3.0 g/l. In practice, the iron removal is done on a batch processing basis. The iron concentration within the plating bath 30 is monitored and when concentrations reach a level of about 1.0 g/l Fe, a portion of the plating bath solution is directed via line 80 into a reaction tank 82 which is provided with heating means 84 as well as a mixer (not shown). This batch of plating bath solution is heated within the reaction tank 82 to a temperature of about 130° F. while the solution is continually mixed. A metal oxide, such as zinc oxide, from source 86 is added to the reaction tank 82 to partially neutralize the free acid within the solution according to equation (3):

$$ZnO+H_2SO_4 \rightarrow ZnSO_4+H_2O \quad (3)$$

The iron is then precipitated out of solution by oxidation of the iron from the ferrous to the ferric state via addition of hydrogen peroxide from source 88 to the reaction tank 82. This reaction proceeds as given below:

$$2ZnO+H_2O_2+2FeSO_4+2H_2O \rightarrow 2Fe(OH)_3+2ZnSO_4 \quad (4)$$

A diatomaceous earth filter aid is added to the reaction tank 82. Typical of such diatomaceous earth filter aids is Eagle Pitcher FW-12 ®. Approximately 4.5 pounds of diatomaceous earth are added for each pound of iron to be extracted. Mixing within the reaction tank 82 must continue until filtration is complete in order to prevent settling of solids within the tank 82. The resultant iron hydroxide slurry is then filtered using a conventional plate-and-frame press 90 to yield a filter cake and electrolyte solution. The filter cake contains iron, as well as zinc and nickel salt. This metal-rich filter cake is sent for subsequent separation of the metal salts from the iron and the filter aid. The extracted metal salts are processed to a metal carbonate salt prior to return to the plating bath 30. The purified electrolyte solution containing acid is directed from the filter press 90 via line 92 and into a holding tank 94 for eventual return through line 96 to the plating bath 30.

FIG. 3 illustrates the secondary nickel and zinc reclamation from the numerous process streams which escape ion exchange reclamation and exist as very dilute reject flows from preceding metal recovery steps, or emanate from sump wastewater spills or similar dirty process flows. All of these streams share a common characteristic of being too variable in flow and/or concentration for primary ion exchange treatment. To avoid loss of nickel and zinc metals contained in these dilute streams, a precipitation and filtration step is added.

Ion exchange raffinate from waste streams exiting lines 66 and 68 of ion exchange units 58 and 60 contain minute concentrations of nickel and zinc which were not adsorbed in the units. Backwash streams produced from the periodic cleaning of the activated carbon filters 44 and 46 exit via line 98, as do filter bypass streams coming directly from the plating bath itself. This relatively concentrated stream is directed to sump 100 which is also positioned to receive spills and excess flows from plating solution storage tanks 104. All of these combined flows are directed via line 106 into storage tank 101. If storage tank 101 is filled to capacity, then excess flows from sump 100 may be diverted through line 108 into storage tank 102. Sump 34 also receives overflow and spills from the plating bath 30 and directs these streams via line 110 into storage tank 101. As with the preceding streams, if storage tank 101 becomes filled to capacity, then flow from sump 34 will proceed down alternate line 112 into storage tank 102. Tank 102 will typically receive the end-of-run washdowns.

These various blended process streams are directed to equalization tank 114 where the streams are combined in order to produce a somewhat uniform mixture. This mixed stream in equalization tank 114 is then subjected to a two-step precipitation process in reaction tanks 118 and 126. A sodium hydroxide tank 120 adds a 50% sodium hydroxide solution to the Stage I reaction tank 118 where any free acid in the blended, wastewater mixture is first neutralized. The concentration of the caustic, or the form used is not critical. Although sodium hydroxide is preferred, a combination of sodium carbonate and sodium hydroxide or the use of other base materials such as calcium oxides i.e. slaked lime or even potassium hydroxide may be substituted for reasons of economy. The sodium hydroxide or other strong base is added to reaction tank 118 to increase the pH of the blended wastewater mixture within a range of about 5.0 to about 7.0, with a preferred pH of 6.5.

Detention time for neutralization within reaction tank 118 generally ranges from about ten minutes to about sixty minutes, depending upon the reaction taking place and the base used. Sodium carbonate reacts rapidly with free acid in solution and a twenty minute period is usually sufficient. Although sodium hydroxide reacts more quickly, a twenty minute detention time is similarly sufficient to effect neutralization at a pH of about 6.5. The nominal flow rate of the wastewater pumps is about 50 gpm. In practice each of the pumps discharge up to about 80 gpm, depending on the head in the equalization tank 114. The combined flow from two pumps is generally about 125 gpm. Allowing for a sodium carbonate flow of 5 gpm, a working volume of 1100 gallons is required for a twenty minute detention time in reaction tank 118.

The neutralized stream exits reaction tank 118 via line 124 and proceeds into a Stage II reaction tank 126 where sodium hydroxide solution, or other strong base, from tank 120 is added per line 128. This second treatment step is controlled so as to precipitate out the zinc and nickel hydroxides. The pH should be maintained within a range of about 10.5 to 11.4 although we have found that a relatively high zinc to nickel ratio permits a somewhat broader pH range. Under ordinary conditions, the working volume of this tank is in the order of 1,100 gallons, which provides a twenty minute detention time. In order to maintain the twenty minute detention time with a total forward flow of 125 gpm, a working volume of 2,500 gallons in tank 126 is generally required.

It had been anticipated that the nickel precipitate would go back into solution at a pH in excess of 10.5, and that the remaining nickel hydroxide would be "slimy" and not suitable for filtering on a conventional filter press employing no filter aids. Applicants have unexpectedly discovered that, by using the present method, a high quality and relatively dry filter cake will result with high recovery of both nickel and zinc. In a modification, up to seventy five gpm of neutralized slurry from reaction tank 120 is recycled to a small reactor (not shown) where it is mixed with additional sodium hydroxide. This mixture would then be directed into the second reaction tank 126 for enhanced precipitate recovery.

Figure 4:
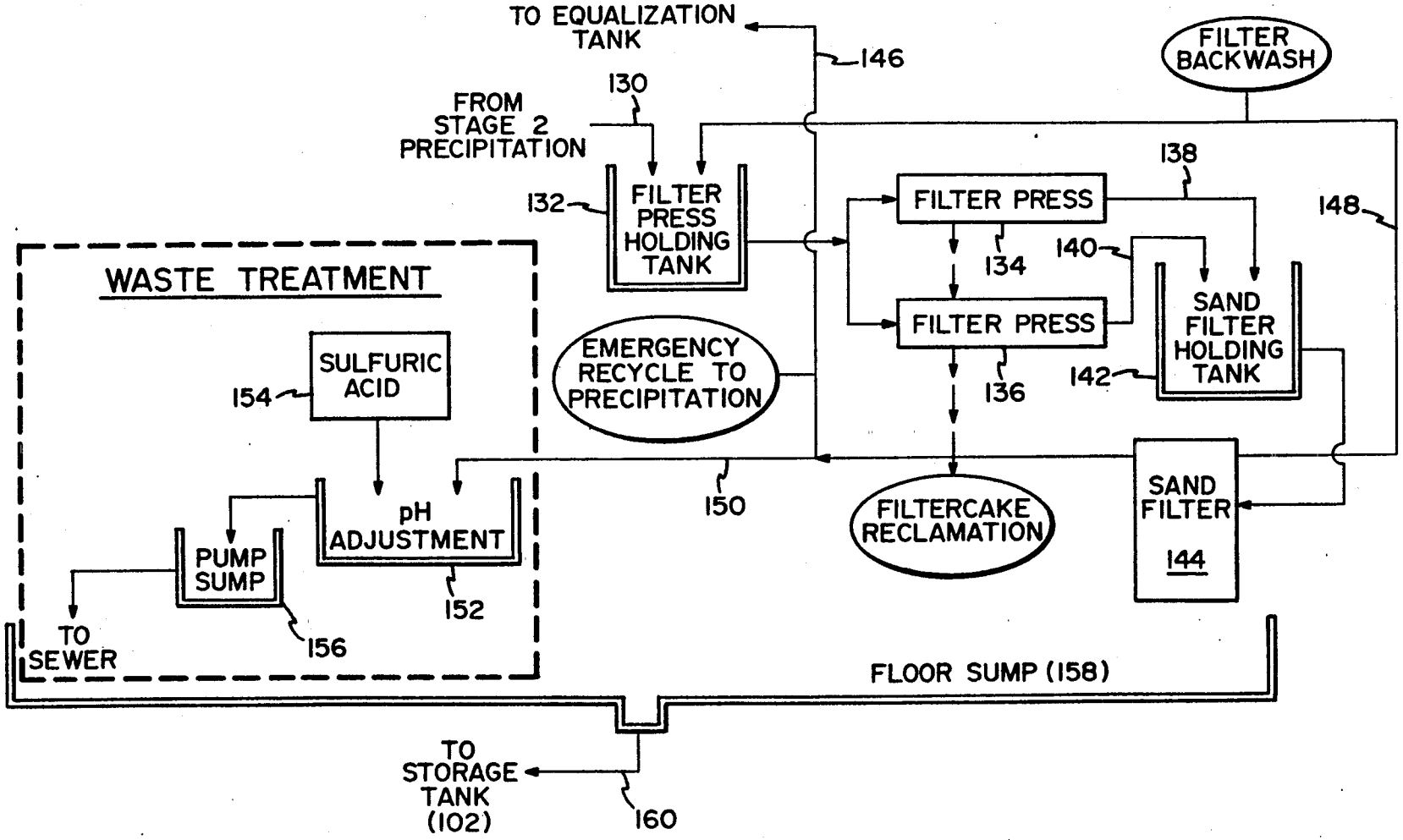
FIG. 4 is a fragmentary schematic diagram of the filtering process for the precipitated metals shown in FIG. 3.

As best shown in FIG. 4, the nickel/zinc hydroxide precipitate from the Stage II reaction tank 126 is directed via line 130 into a filter press holding tank 132. The metal hydroxide slurry within the filter press holding tank 132 is directed to conventional filtration means 134 and 136. Plate-and-frame filters or vacuum leaf filters are preferred. The wet zinc/nickel hydroxide filter cake is then collected in hoppers (not shown) for subsequent use. Filter pressure should be in the range of between about 75 psi to about 125 psi, with a preferred pressure of 90 psi to yield a high quality filter cake. As a result, essentially no metal is discharged into the sewer system, and applicants are aware of no other waste processing system for plating metals which attains such high recovery levels.

To increase the metal extraction from the process effluent streams 138 and 140, the effluent is directed to a holding tank 142 prior to subjecting the effluent to additional filtering in a continuously backwashed upflow filter or high-rate sand filter 144. The nickel and zinc solids removed in this second filtration process can then be returned to the filter press holding tank 132 via line 148. The high-rate sand filter 144 also has the capacity to recycle the filtrate back to equalization tank 144 via line 146.

The effluent stream leaving the sand filter 144 is acceptable for discharge once the pH is adjusted. Line 150 directs a portion of the metal deficient stream exiting the sand filter 144 into a pH adjustment tank 152. Sufficient sulfuric acid solution is then added to tank 152 from tank 154 to adjust the pH within an acceptable levels prior to its discharge via pump sump 156 into the discharge line. A floor sump 158 is provided to collect discharge and spills from every portion of the metal recovery system and to direct these discharges via line 160 into storage tank 102.

Nickel/zinc wet filter cake extracted from filter presses 134 and 136 may be redissolved with a concentrated acid solution and then processed to yield a salt or a solution which is usable as a feedstock for the plating process. For example, the nickel/zinc wet filter cake may first be redissolved in sulfuric acid. The metals are then precipitated as carbonate salts, using sodium bicarbonate or sodium carbonate. These resulting salts can be used to supply metal to the original plating bath without introducing unwanted anions into solution. Metal solution obtained from redissolving the filter cake may also be further purified using the activated carbon treatment or the iron removal step via pH adjustment and filtration. These resultant solutions can also be used to prepare the metal salts.

While this invention has been described as having a preferred design it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention and the limits of the appended claims.

What we claim is:

1. The method of recovering useful metals used in a plating system from a plurality of process streams including the steps of:

a) providing a first process stream having a constant flow and concentration of a useful metal;

b) concentrating the useful metal in the first stream to a level sufficient to permit return thereof to the plating system and thereby simultaneously create a dilute raffinate stream;

c) providing a second process stream having a varying flow and concentration of a useful metal;

d) blending the raffinate stream with the second process stream and thereby creating a blended stream;

e) subsequently neutralizing free acid in the blended stream by adding a base thereto;

f) subsequently precipitating the useful metal in the neutralized stream by adding a sufficient amount of base thereto; and, g) removing water from the precipitated useful metal.

2. The method of claim 1, and wherein:

a) concentrating the useful metals from the first stream by a process selected from the group consisting of ion-exchange, electrodialysis, reverse osmosis and solvent extraction.

3. The method of claim 2, including the step of:

a) passing the first stream through an ion exchange column and separating the first stream into cations and anions of the useful metal, and feeding the cations to the plating system.

4. The method of claim 1, including the step of:

a) neutralizing the free acid and precipitating the useful metal by the addition of a common base.

5. The method of claim 4, including the steps of:

a) providing a bed of styrene based cation resin in an ion exchange column to selectively sorb the useful metal to the resin;

b) washing the cation resin with an acid to release the sorbed useful metal into a recovered solution for return to the plating solution; and, c) contacting the recovered solution with a deacidification resin to separate the residual acid.

6. The method of claim 1, including the step of:

a) neutralizing the free acid and precipitating the useful metals in a two-step process.

7. The method in claim 6, including the step of:

a) neutralizing and precipitating the free acid by the addition of a strong base.

8. The method of claim 7, including the step of:

a) selecting the strong base from the group consisting of hydroxides, carbonates, and calcium oxides.

9. The method of claim 7, including the step of:

a) removing the water from the precipitated metals by filtering.

10. The method of claim 8, including the step of:

a) neutralizing the free acid by adding a strong base to the blended stream and thereby raising the pH to between about 5.0 to 7.0 pH.

11. The method of claim 10, including the step of:

a) selecting a first stream and second stream comprising zinc and/or nickel.

12. The method of claim 10, including the step of:

a) precipitating the useful metal in the neutralized, blended stream by raising the pH to about 10.5 to about 11.4.

13. The method of recovering nickel and zinc metals used in a plating system from a plurality of process streams including the steps of:

a) providing a first process stream having a constant flow and concentration of nickel and zinc;

b) concentrating the nickel and zinc in the first stream to a level sufficient to permit return thereof to the plating system and thereby simultaneously create a dilute raffinate stream;

c) providing a second process stream having a varying flow and concentration of nickel and zinc;

d) blending the raffinate stream with the second process stream and thereby creating a blended stream;

e) subsequently neutralizing free acid in the blended stream by adding a base thereto;

f) subsequently precipitating the nickel and zinc in the neutralized stream by adding a sufficient amount of base thereto;

g) removing water from the precipitated zinc and nickel to yield a cake material; and, h) recovering the nickel and zinc from the cake material.

14. The method of claim 13, including the step of:

a) increasing the pH of the neutralized stream by an amount sufficient to precipitate zinc and nickel from the neutralized stream.

15. The method of claim 14, including the step of:

a) increasing the pH to between about 10.5 to about 11.4.

16. A system for recovering useful metals used in a plating system from a plurality of process streams, the system comprising:

a) first means for providing a first process stream having a constant flow and concentration of a useful metal;

b) second means for concentrating the useful metal in the first stream to a level sufficient to permit return thereof to the plating system and thereby simultaneously create a dilute raffinate stream;

c) third means for providing a second process stream having a varying flow and concentration of a useful metal;

d) fourth means for combining the raffinate stream with the second stream to thereby create a blended stream;

e) fifth means for neutralizing free acid in the blended stream by adding a base thereto;

f) sixth means for precipitating the metals in the neutralized stream by adding a sufficient amount of base thereto;

g) seventh means for removing water from the precipitated metal to yield a cake material; and, h) eighth means for recovering useful metal from the cake material.

17. The system of claim 16, and wherein:

a) said second means for concentrating is selected from the group consisting of ion-exchange means, electrodialysis means, reverse osmosis means and a solvent extraction means.

18. The system of claim 16, and wherein:

a) said sixth means for removing water including a filter press.

* * * * *